US009701460B2

(12) United States Patent
Petrov

(10) Patent No.: US 9,701,460 B2
(45) Date of Patent: Jul. 11, 2017

(54) FLUID MIXING AND DISPENSING CONTAINER

(71) Applicant: Inventure Labs LLC, Jersity City, NJ (US)

(72) Inventor: Stan C. Petrov, Costa Mesa, CA (US)

(73) Assignee: INVENTURE LABS LLC, Jersey City, NJ (US)

( * ) Notice: Subject to any disclaimer, the term of this patent is extended or adjusted under 35 U.S.C. 154(b) by 59 days.

(21) Appl. No.: 14/098,192

(22) Filed: Dec. 5, 2013

(65) Prior Publication Data

US 2015/0158654 A1 Jun. 11, 2015

(51) Int. Cl.

| | |
|---|---|
| ***B65D 81/32*** | (2006.01) |
| ***B65D 25/20*** | (2006.01) |
| ***B65D 85/00*** | (2006.01) |
| ***B65D 83/28*** | (2006.01) |
| ***B65D 83/52*** | (2006.01) |
| ***B65D 25/04*** | (2006.01) |
| ***B65D 25/44*** | (2006.01) |
| ***B05B 9/08*** | (2006.01) |
| ***B01F 13/00*** | (2006.01) |
| ***B01F 13/10*** | (2006.01) |
| ***B01F 15/02*** | (2006.01) |

(52) U.S. Cl.

CPC ..... *B65D 83/525* (2013.01); *B01F 13/002* (2013.01); *B01F 13/1061* (2013.01); *B01F 15/0238* (2013.01); *B05B 9/0833* (2013.01); *B01F 2215/0031* (2013.01); *B01F 2215/0032* (2013.01)

(58) Field of Classification Search

CPC B01F 13/002; B01F 13/1061; B01F 15/0238; B01F 2215/0031; B01F 2215/0032; B05B 9/0833; B05C 17/00503; B05C 17/00556; B65D 83/525; B65D 83/663

See application file for complete search history.

(56) References Cited

U.S. PATENT DOCUMENTS 2,973,885 A * 3/1961 Ferguson ..... B65D 83/14 222/399
2,976,897 A * 3/1961 Beckworth ..... B05B 9/0833 141/17
3,511,418 A * 5/1970 Frank, Jr. ..... B65D 83/525 222/402.2

(Continued)

FOREIGN PATENT DOCUMENTS

EP 1 350 739 10/2003
WO WO 02/22467 3/2002

*Primary Examiner* — Nicholas J Weiss

(57) ABSTRACT

A handheld reusable multi-compartmental mixing and dispensing container for storing fluids separately therein before mixing. The proportions of the substances in a mixture are externally adjustable. The desired concentration is determined by test components attached to the container that sense various environmental and user-specific factors. The amount of the adjustable substance to be added to a mixture is controlled by an adjustment wheel on the container. A single control button allows a user to choose what fluid substances are to be mixed and dispensed. A pressurized gas propellant in a replaceable canister moves the fluid around and out of the container.

2 Claims, 18 Drawing Sheets

(56) References Cited

U.S. PATENT DOCUMENTS 3,558,010 A * 1/1971 Zenger ..... B05B 1/30 141/19
4,335,837 A * 6/1982 Bono ..... B01F 15/0462 222/137
4,818,491 A * 4/1989 Fariss ..... G01J 1/58 116/207
4,838,457 A * 6/1989 Swahl ..... B65D 35/28 222/105
4,893,729 A 1/1990 Iggulden et al.
4,993,594 A * 2/1991 Becker ..... B01F 13/002 137/607
5,589,398 A 12/1996 Krause et al.
5,612,542 A * 3/1997 Brown ..... G01J 1/50 250/474.1
5,638,992 A 6/1997 Lim et al.
5,647,513 A * 7/1997 Favre ..... B65D 81/3227 222/134
5,848,732 A * 12/1998 Brugger ..... B05B 11/3083 222/137
6,394,364 B1 * 5/2002 Abplanalp ..... B65D 83/66 222/145.1
6,405,867 B1 * 6/2002 Moore ..... B65D 1/0207 206/459.1
7,509,839 B2 * 3/2009 Duranton ..... A45D 33/26 206/581
8,118,193 B2 * 2/2012 Law ..... A45D 34/04 222/205
8,224,481 B2 * 7/2012 Bylsma ..... A61M 5/1413 222/129.4
8,596,498 B2 * 12/2013 Werner ..... B05B 11/3083 222/132
8,800,818 B2 * 8/2014 Greenberg ..... B05B 11/3059 222/135
8,857,738 B2 * 10/2014 Knopow ..... B05B 7/2443 222/144
2008/0259315 A1 10/2008 Mersch
2009/0152300 A1 6/2009 Hayman et al.

* cited by examiner

FLUID MIXING AND DISPENSING CONTAINER

BACKGROUND OF THE INVENTION

1. Field of the Invention

The present invention relates to a hand-held reusable multi-compartmental mixing and dispensing container that permits a user to customize a mixture of fluids to be dispensed.

2. Description of Related Art

As science and medicine have added to our knowledge base, our understanding of the human body and effects of various environmental factors on it has advanced. We are adept at manufacturing and using various substances to enhance our appearance, protect us from the environment, improve our health, for example. The market is flooded with cosmetics and pharmaceutics.

Currently most of these compounds come premixed, or, at most, in containers that allow one time mixing and dispensing in preset proportions. But, the human body and the environment are both dynamic. As a result, the cosmetic or pharmaceutical mixture being dispensed is rarely, if ever, specifically tailored to the individual and her environment.

For example, sunscreens are produced with a specific preset amount of UV protective factors (SPF), emollients, and fragrances. As a consumer uses the product, the contents of the sunscreen being dispensed cannot be adjusted to take into account the changes in her skin color, the time of day, the weather, her individual preferences, or even whether it is more convenient to use a spray or a cream. Similarly, hair dyes are provided in a limited number of colors. A user is left to figure out what shade would work best with her hair color and type. It is not possible to do a match with any degree of accuracy. The containers used are not amenable to mid-stream changes in the relative proportions of the ingredients. The containers are not capable of dispensing a test sample. Dispensing of medicinal creams and lotions also presents a problem. Although dermatologists, and other physicians who treat skin conditions, most commonly prescribe the use of steroids, anti-fungal agents, antibiotic creams and emollients, there are no containers available that allow a patient to mix the cream and lotion at will, and dispense the mixture as a unit.

As a result, a user does not experience the full benefits of a product simply because the mixture has not been tailored to meet their individual needs. They end up buying and using multiple products, which will be less effective. This has a negative impact on both the consumer and the environment. Plastic containers are a large contributor to landfill waste. Moreover, disposal of containers with product may be toxic.

With regard to medicinal applications there is a significant risk that patients who must juggle multiple medications or creams that neglect one or more of the necessary components of their treatment plan. About 50-75% of patients are noncompliant with regard to their prescriptions. Only 20% of diabetics adhere to their insulin administration regime faithfully. This is very expensive in terms of human health and the economy. In fact, it has been estimated that non-compliance with healthcare regimes "accounts for up to $100 billion in healthcare and productivity costs.

A dispensing and mixing container that takes into account the uniqueness of the each user, as well as the real-time environmental factors, providing personalized cosmetics, dermatologic creams, or administration of medications is needed. The current state of the art does not provide such a device.

With regard to dispensing containers, there are various types available:

U.S. Pat. No. 4,893,729 by Iggulden, Streck describes a bottle designed to dispense various mixtures of lotion and UV protective agents. The dispenser uses bores, does not have a self-retractable tip, is not powered by a pressurized gas canister, and does not give the user guidance as to the right amount of sunscreen agent or other compound that should be added. It cannot be personalized.

EP 1350739, US 2009/0152300, U.S. Pat. No. 5,638,992, and WO 2002/022467 all describe containers that mix two fluids. In EP 1,350,739, separation is maintained by a breakable seal. In US 2009/015230, it is not. In U.S. Pat. No. 5,638,992, the inner pressurized container bursts causing mixing. In WO 2002/022467, the compounds remain separate until dispensed and are not mixed. In none of these examples, is the user able to select the proportions of the compounds that will form a part of a final mixture. Mixing is done on a one-time basis. The amounts dispensed are not user-determined by test amounts. These prior art examples do not allow the product to be personalized.

With regard to UV detection and measuring, various products have been devised.

U.S. Pat. No. 5,589,398 by Krause et al. describes UV Fastcheck strips. Test strips that use a photoactive chromogenic substance to detect sunburn-causing UV radiation. These test strips do not take into account a user's skin color, are for one-time use only, are not paired with a sunscreen mixer and dispenser, and do not allow the user to choose between spray or cream. Furthermore, exposure to light causes the UV Fastcheck strips to lose their function.

US 2008/0259315 by Mersch utilizes titanium dioxide and resazurin to create an irreversible change upon UV exposure. This will allow a user to determine when they have been exposed to excess UV radiation. It will not advise a user, in advance, about the sunscreen protection necessary. It will not tell a user whether a sunscreen is effective.

A UV Sun Strength Warning band operates via photochromic dyes. The band does not take a user's skin color into account.

Therefore, although there are various mixing bottles and test strips on the market, none of these products provide repeated consistent mixing and dispensing of varying proportions and amounts of the contained substances. None allow the substance to be altered by the user each time a mixture is dispensed, informed by measurements resulting from the use of test components that sense the environment and the user, and are fixed to the surface of the container.

SUMMARY OF THE INVENTION

A multi-compartment container capable of mixing adjustable proportions of one substance with one or more other substances, and selectively dispensing varying amounts of the mixture via a user-selected system is provided. The desired proportions of substances within a mixture are determined according to input received from test components or other interfaces that sense various environmental and user-specific factors.

The container holds various substances in separate compartments without allowing them to mix, preventing chemical interaction and extending shelf life. The compartments are refillable, making it possible to give the user a range of choices for what they would like to mix. For example, in the case of sunscreen, the user could have a choice between the type of UV filtering agent, the fragrance, the emollient content, whether the mixture is dispensed as spray or cream.

In the case of a dermatologic treatment agent, the user could choose the amount of emollient needed and, based on input from a treating physician, whether it is mixed with a steroid or, for example, an anti-fungal. In the case of medication for diabetes, a patient could be administered an individually tailored mixture of fast and slow-acting insulin mixed with diluent or another substance, based on factors such as their blood sugar and the time of day.

The user can choose the proportion of each substance that will be mixed. This choice is guided by a system of environmentally and user-sensitive test components. For example, a built-in UV graded test strip will detect UV light and quantify it into a number. This number can be correlated with a strip that takes into account skin color, a natural defense against UV rays, adjusting the number provided by the UV graded strip. The user can then determine the UV protection for their skin and adjust the substance dispensed from the container by the adjustment wheel. A separate multi-function push button controls the amount and flow of the substance dispensed.

Expulsion of a final mixture is accomplished by retractable nozzles. The pushbutton, based on direction of operation, allows the user to select cream, spray, or alternate applications. Nozzles are designed to prevent spillage, or the buildup of debris. A pressurized gas system that uses a replaceable cartridge moves the mixture. Because there are no electronic components or batteries, the container of the present invention is both lightweight and environmentally friendly.

BRIEF DESCRIPTION OF THE DRAWINGS

The exact nature of this invention, as well as the objects and advantages thereof, will become readily apparent from consideration of the following specification in conjunction with the accompanying drawings in which like reference numerals designate like parts throughout the figures thereof and wherein:

FIG. 15A shows the pushbutton in neutral position resulting in no propellant flow;

FIG. 15B shows the bottom part of the pushbutton depressed;

FIG. 15C shows the top part of the pushbutton depressed;

FIG. 15D shows the self-retracting pressure nozzles opening a pressurized substance is delivered by the pipe;

DETAILED DESCRIPTION OF THE PREFERRED EMBODIMENTS

Figure 1:
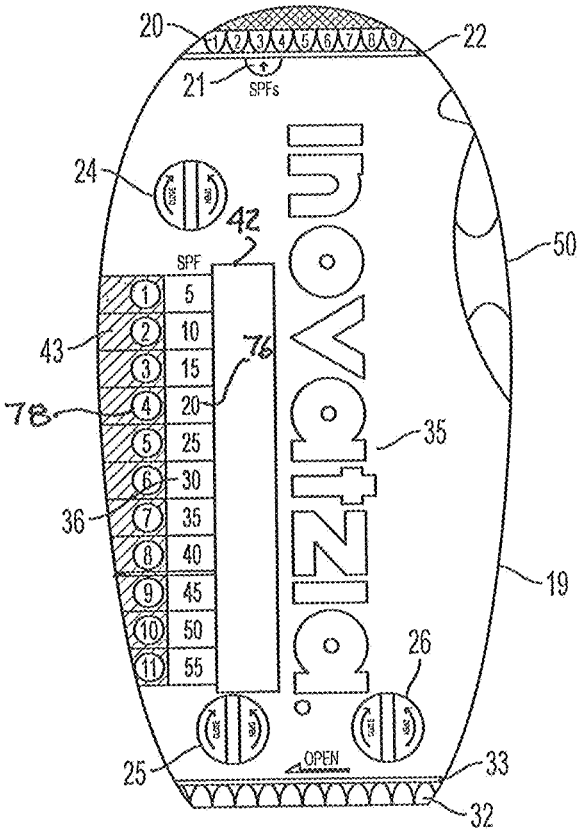
FIG. 1 is a front view of the outside of a preferred embodiment of the container according to the invention, showing a temperature sensitive logo and environmentally and user sensitive test components.

A preferred embodiment of the container of the invention that is used to dispense sunscreen lotion or spray, is shown in FIG. 1. A clicking adjuster wheel 20 on top of the container 19 (shown in detail in FIG. 13) allows a user to select the proportion of substance, such as UV light protectant, for example, that is mixed in with one of the other two substances in the container. The clicking adjuster wheel 20 provides precise control of the amount of substance added to a mixture, as will be explained hereafter. In the case of UV light protectant, a sun protective factor (SPF) adjustor arrow 21 points to an adjustor wheel symbol 79 that correlates with the SPF of the substance being dispensed. The SPF arrow 21 also correlates with the number of clicks that the user perceives when moving the wheel from a neutral position. The upper frictionless ring 22 separates the clicking adjustor wheel 20 from the container 19, allowing smooth movement during user adjustment.

Figure 3:
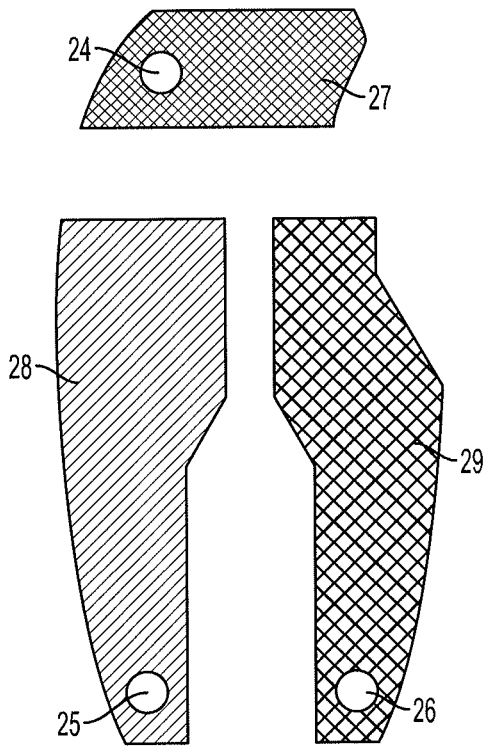
FIG. 3 is an illustration of the separate internal compartments within the container of FIG. 1, showing threaded openings for the slotted fill-in caps for each internal compartment.

The container 19 houses three major components, 27, 28 and 29, shown in FIG. 3 which have openings 24, 25, 26, for fill caps. The container 19 is preferably made of aluminum/zirconium. But other moldable equally durable materials such as polymers may be used for example. Three threaded openings in the container pass through the container to the openings (FIG. 3) in their respective compartments 27, 28 and 29 (FIG. 3) and are secured by slotted fill caps 24, 25 and 26 (FIG. 1). Each cap features a coin-width slot in its surface for easy opening. Substances are added to the internal compartments 27, 28, 29 (FIG. 3) after removing the slotted fill caps from threaded openings 24, 25, 26 (FIG. 1). The contents, composition and nature of the various compartments can be adjusted, according to user and manufacturer preferences. In a preferred embodiment, the internal compartments 27, 28, 29 may be filled with various substances. UV light protectant may be in one compartment one, 27. A cream based emollient may be in a second compartment 29. Fluid for spraying may be in a third compartment 28.

Figure 6:
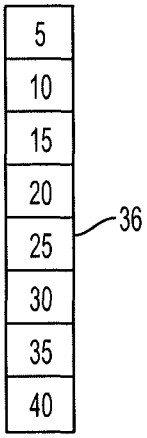
FIG. 6 illustrates a graded multilayered UV light sensitive strip with its light sensitive symbols surrounded by non-light reactive reflecting paint.

Referring again to FIG. 1, several environmentally sensitive components are built into the container. In a preferred embodiment, a centrally located temperature and moisture-sensitive logo 35 alerts the user when the container 19 has been exposed to environmental changes such as temperature, for example, that could prevent optimum function. Test components are located to one side of the temperature and moisture logo 35, and can be adjusted to manufacturer's and user's specifications. In the case of the container 19 being used for UV product, a graded multilayered UV light-sensitive strip 36 is located on one side of the logo 35. This graded multilayer UV light-sensitive strip 36 is shown in more detail in FIG. 6 and FIG. 7.

Figure 7:
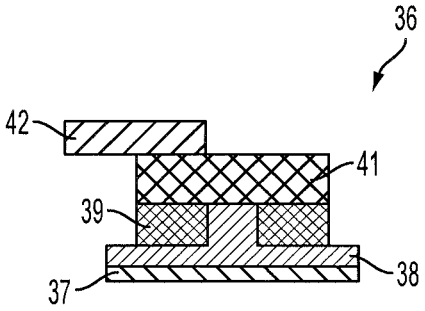
FIG. 7 is a cross section of the graded multi-layered UV light sensitive strip of FIG. 5, showing its multilayer composition.

Referring to FIG. 7, the base layer 37 of the graded multilayered UV light sensitive strip 36 is a non-thermo-conductive light-reflective layer, that besides providing some thermal insulation to the container 19 contents, is combined with adhesive on the underside, that allows the strip 36 to be securely attached to the external surface of the container 19. The next layer 38, 40 is a non-light-reactive reflective paint. The operational part of the strip is partially contained in the next layer, which contains light sensitive symbols 76 (FIG. 1) made of paint 39. The next layer 41 is a graded UV light variable filter as found in UV shielded glass windows, films, and other applications, for example. Although FIG. 7 only shows one grade of graded UV light variable filter 41, the filter 41 has consecutive grades 42 adjacent to each other forming a strip. When exposed to light, as the light intensity increases and more UV can propagate through a particular grade of the filter 41, the light reactive reflecting paint 39 under that filter 41 will react by contrasting with the non-light reactive paint 38, creating a light sensitive symbol 76. In summary, when the amount of UV light goes beyond the filter capabilities of the graded UV light variable filter 41, light is able to reach the light reflective paint 39 and change its color and its contrast by using the non-reflecting paint 38 in the same layer. A light sensitive symbol 76, is displayed which correlates with the adjustor wheel symbol 79 to the number of clicks of the upper wheel needed to dispense the correct amount of SPF.

Referring again to FIG. 1, as well as FIG. 7, a sliding graded multilayered UV light sensitive strip cover 42 is used to block the light from activating the light reflective paint 39 so that the light reflective paint 39 is kept safe from damage, thereby increasing shelf life. If desired, the user can self-test the UV protection cream being dispensed by applying a small amount directly to the light sensitive strip 36. This tells the user whether the sunscreen being dispensed is sufficient protection for the particular day, time, skin color and location.

Figure 8:
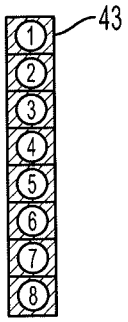
FIG. 8 is a front view of a multilayer skin color match sticker system used in the preferred embodiment of the present invention.
Figure 9:
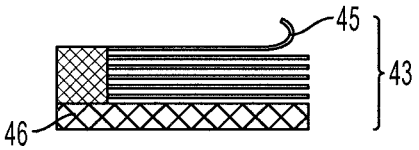
FIG. 9 is a cross-section of the multilayer skin color match sticker system of FIG. 8 showing the individual layers.

As shown in FIGS. 1, 8 and 9, multilayer skin color matching sticker system 43 is located directly adjacent to the graded multilayered light sensitive strip 36. Layers 45 may be removed to allow a user to match their own skin color with a matching color spot on the strip. Each numbered skin color sticker thereafter becomes progressively darker. The skin color stickers 43 have numbers thereon. They are attached to the container 19 by means of an adhesive layer 46. A user locates where the graded multilayered light sensitive strip 36 changes color causing the respective light sensitive symbol 76 to become visible. The light sensitive symbol 76 is matched to the number located adjacent to this symbol on the skin color sticker system 43. The number 78 on the skin color sticker will correspond to a number on the adjuster wheel 20 which when set to this number, causes the container 19 to dispense the correct level of UV protective cream based emollient, or spray, for that user's skin color.

Figure 2:
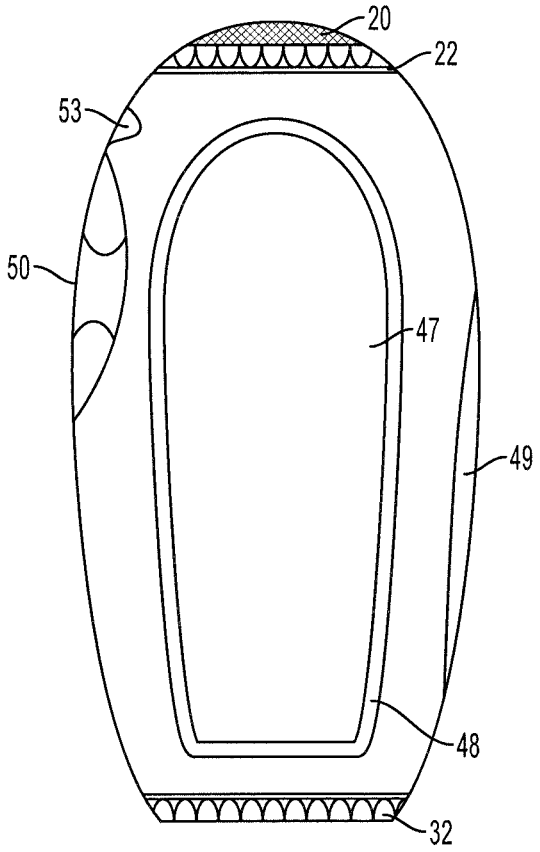
FIG. 2 is a rear view of the outside of the container of FIG. 1 illustrating a replaceable friction plate that fits in a surrounding silicone ring.
Figure 10:
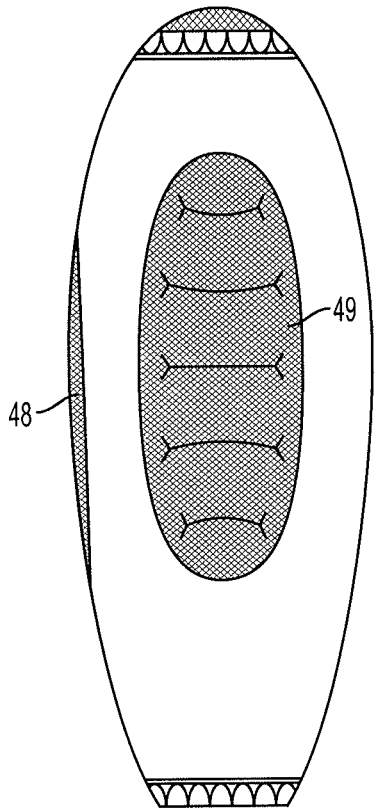
FIG. 10 is a view of the left side of the container of FIG. 1, showing a replaceable silicone hand grip pad.

The rear of the container continues with the goal of being ergonomic (FIG. 2). It includes a replaceable friction plate 47. The replaceable friction plate 47 is surrounded by a silicone ring 48 that will ensure that the container does not easily move when placed on a surface. This also makes it easier to replace the reflective plate. To provide holding comfort, a replaceable silicone hand grip pad 49 (FIG. 10) gives the user a steady grip on the container when discharging its contents.

Figure 12:
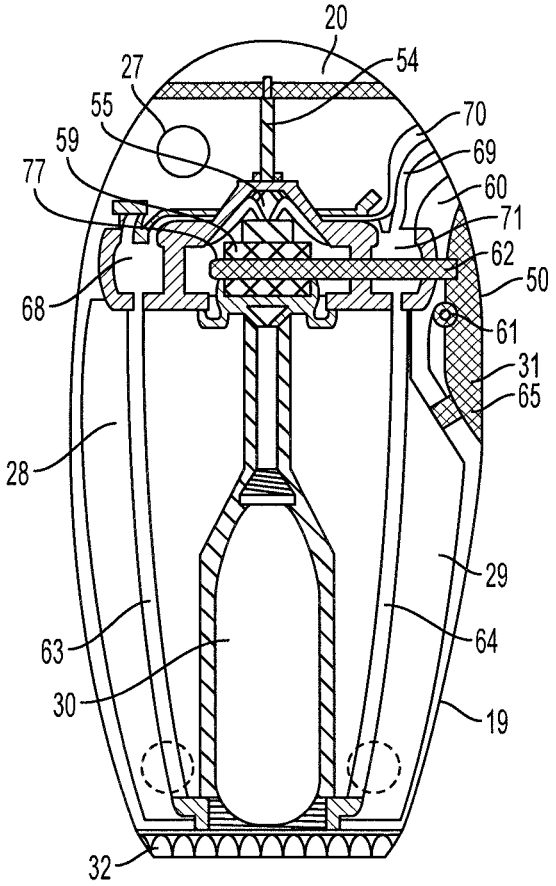
FIG. 12 is a cross section of the container of FIG. 1 showing the major internal components of the container.
Figure 13:
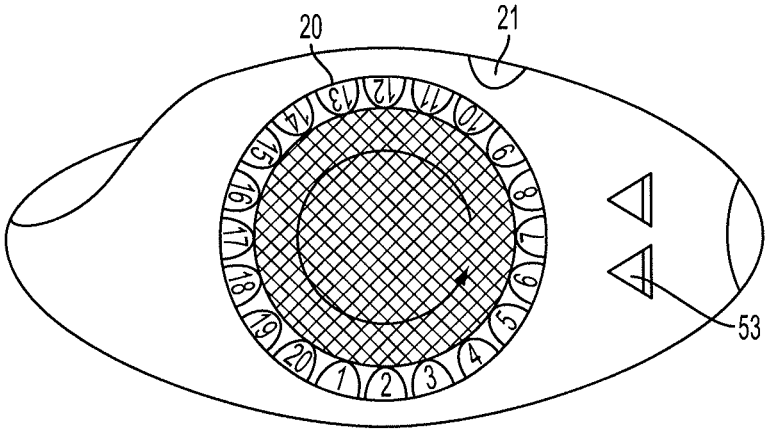
FIG. 13 is a top view of the container of FIG. 1 showing self-retractable pressure nozzles and an adjustment wheel used to regulate the outflow of substance.
Figure 14:
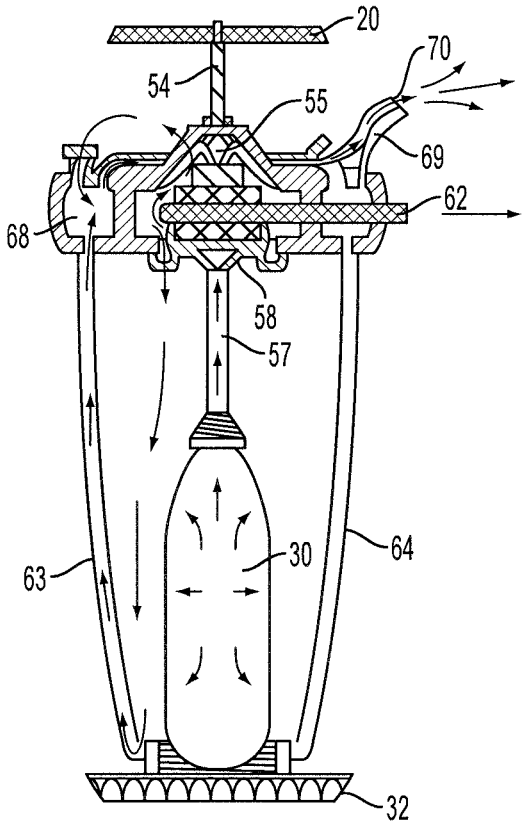
FIG. 14 is a partial cross-section of the container of FIG. 1, showing the internal components and movement of propellant, substance, and mixture throughout the components of the container when the lower part of the pushbutton is depressed.

FIG. 12 shows an overview of the internal components of the container 19 and their relationship to each other. A clicking adjuster wheel 20 at the top of the container 19 is paired with adjustor shaft 54 to a threaded conically-shaped flow-regulating valve 55. The top of the container and the clicking adjustor wheel 20 is shown in FIG. 13. FIG. 14 provides a cross-sectional view of the placement of the internal components with container 19. The function of the clicking adjuster wheel 20 will be discussed more fully hereinafter.

Referring to FIG. 12, at the bottom of the container 19, the pressure cartridge 30 fits between internal compartment two 28 and internal compartment three 29. The pressure cartridge 30 is held in place at the bottom of the container by a threaded wheel base 32, and at the top by a threaded receiving end 31 for the pressure cartridge 30. This is more clearly seen in FIG. 14. As the pressure cartridge 30 is threaded into the threaded receiving end 30, it is pushed and locks into the high pressure propellant pipe 57. The threaded wheel base 32 is separated from the container 19 by a lower frictionless ring 33 that makes removal and attachment of the threaded wheel base 32 easier.

When the pushbutton 50 is in neutral position, propellant is only present in the high pressure propellant pipe 57. Propellant flow is restricted by a ball bearing one-way pressure valve 58 (FIG. 14). A rubberized piston 59 pushes the ball bearing valve down into a closed position, simultaneously blocking the orifice leading to the high pressure propellant pipe 57, preventing propellant flow. Pushing on the button 50 moves rubberized piston 59 allowing the propellant to flow through the device 19 (FIG. 12).

Referring to FIG. 12, the pushbutton 50 that is located on the side of container 19 controls the flow of the mixture to be dispensed, and whether the substance from internal compartment one 27 is mixed with that from internal compartment two 28 or internal compartment three 29. An axle 61 goes through the pushbutton 50 allowing it to pivot. A main shaft 62 connects the top of the pushbutton 50 to rubberized piston 59 and two rubber bearings 77. When the top of the pushbutton 50 is depressed, the main shaft 62 and the rubberized piston 59 and rubber bearings 77 are pushed. If the bottom part of the pushbutton 50 is depressed, the rubberized piston 59 and rubber bearings are pulled. This push/pull action determines the direction and amount of propellant that flows through the lower one way check valves 66 and threaded conically-shaped flow-regulating valve 55. The propellant will then enter internal compartment one 27 and either internal compartment two 28 or internal compartment three 29, pushing the substance in those containers into their respective intake pipes, right hand intake pipe 63 or left hand intake pipe 64 (FIG. 14). The push button 50 returns to the neutral position upon release due to the action of springs 65.

Figure 4:
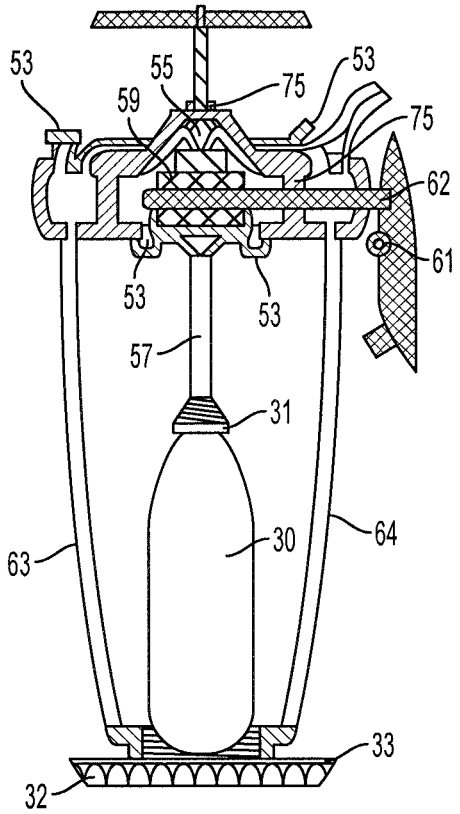
FIG. 4 is a partial cross-section of the container showing the major internal components that regulate the flow of propellant and substance.
Figure 5:
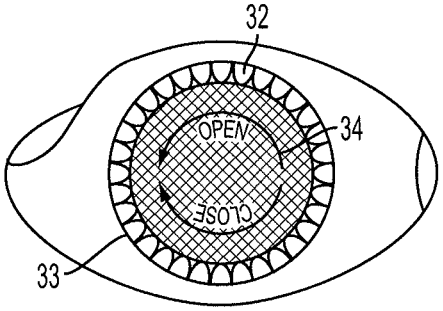
FIG. 5 is a base view of the container showing a threaded wheel in the base that enables access to and replacement of, a pressure cartridge.
Figure 16A:
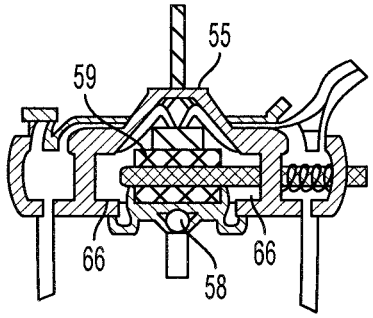
FIG. 16A is a partial cross section that shows the adjusting valve assembly.

A rubberized piston 59 and rubber bearings 77, shown in FIG. 4 and in more detail in FIG. 16A are an important element of the container 19. The rubberized piston 59 and rubber bearings 77 are housed within a chamber containing multiple valves, a threaded conically-shaped flow regulating valve 55 on top and two one-way check valves 66 at the bottom for controlling the direction of flow.

The upper threaded conically-shaped flow regulating valve 55 allows propellant to enter internal compartment one 27. The lower left one way check valve 66 allows propellant to enter internal compartment two 28. The lower right one way check valve 66 allows the propellant to enter internal compartment three 29. As explained above, the ball bearing one way pressure valve 58 is between the two lower one way check valves 66. While the pushbutton 50 is in a neutral position, the ball bearing one way pressure valve 58 blocks flow of propellant because it is depressed by the rubberized piston 59.

Figure 15A:
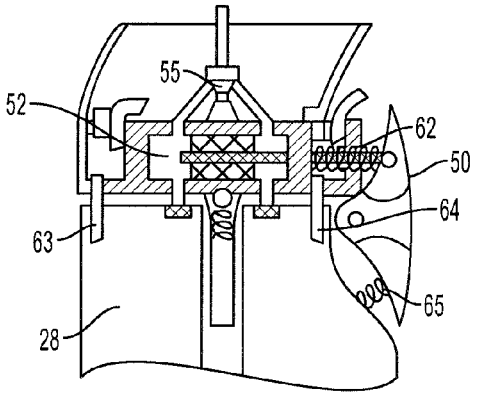
FIGS. 15A, 15B, 15C and 15D illustrate the function of the pushbutton, nozzles, rubber bearings and rubberized piston in the container of FIG. 1.
Figure 15B:
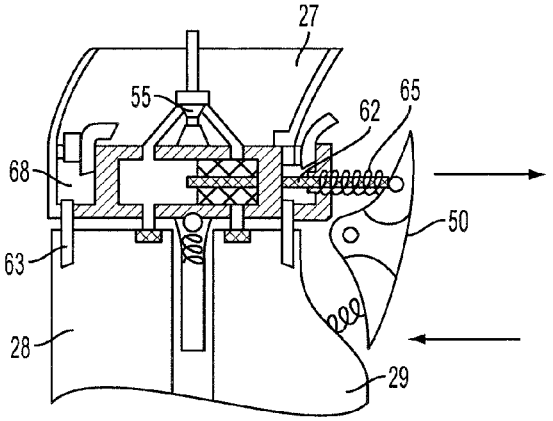

If a user wants to dispense a mixture from internal compartments one 27 and internal compartments two 28, the bottom part of the pushbutton is depressed so the main shaft 62 and rubber bearings 77 are pulled, moving the rubberized piston 59 and rubber bearings 77 to the right, allowing air to flow through the ball bearing one way pressure valve 58, so that propellant is allowed to flow, as shown in FIG. 15B and blocking the one way check valve 66 between internal compartment one 27 and the right hand formed mixing compartment 71. The propellant travels down into internal compartment two 28 via a one way check valve 66, displacing its contents into the left hand formed mixing compartment 68. At the same time, the propellant also moves through the threaded conically-shaped flow-regulating valve 55 and displaces substance from internal compartment one 27 through the unblocked one way check valve 66 into the left hand formed mixing compartment 68. The displaced substance from internal compartment one 27 correlates to the amount of propellant allowed to enter internal compartment one 27 by the threaded conically-shaped flow-regulating valve 55. As shown in FIG. 14, a specified amount of substance is moved into the left hand formed mixing compartment 68. The resultant mixture moves to the left hand mixing pipe 70 that has a spiral insert 82 to help further mix the substances before they are extruded via the self-retractable pressure nozzles 53.

Figure 15C:
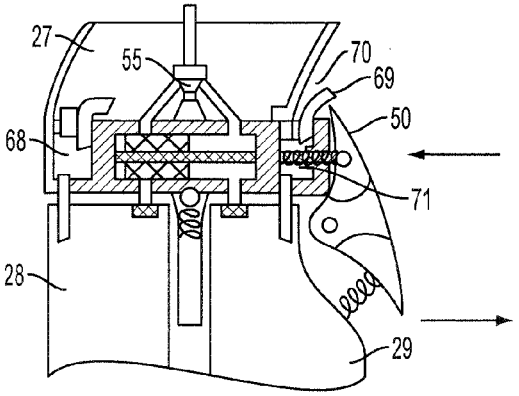
Figure 16B:
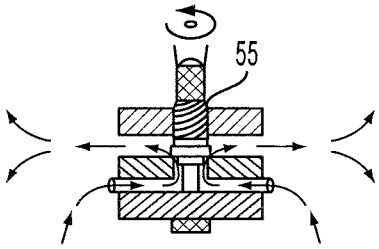
FIG. 16B shows the adjusting valve in a slightly open position.

If a user wants to dispense a mixture from internal compartments one 27 and internal compartment three 29, the top part of the pushbutton is depressed so the main shaft 62 and rubber bearings 77 are pushed, moving the piston 59 and rubber bearings 77 to the left, allowing air to flow through the ball so that propellant is allowed to flow, as shown in FIG. 15C. The one way check valve 66 between internal compartment one 27 and the left hand mixing compartment 68 is blocked. The propellant travels down into internal compartment three 29 by way of right side one way check valve 66, displacing its contents into the right-side mixing compartment 71. Simultaneously propellant travels upwards through the threaded flow regulating conical valve 55 and enters internal compartment one is blocked 27 at the fixed flow rate. This continuously displaces a fixed amount of substance, such as a UV-protective agent. A detailed illustration of the structure of rubberized piston 59 and rubber bearings 77 are shown in FIG. 16A. A detailed illustration of the threaded conical flow regulatory valve 55 is shown in FIG. 16B.

Figure 11:
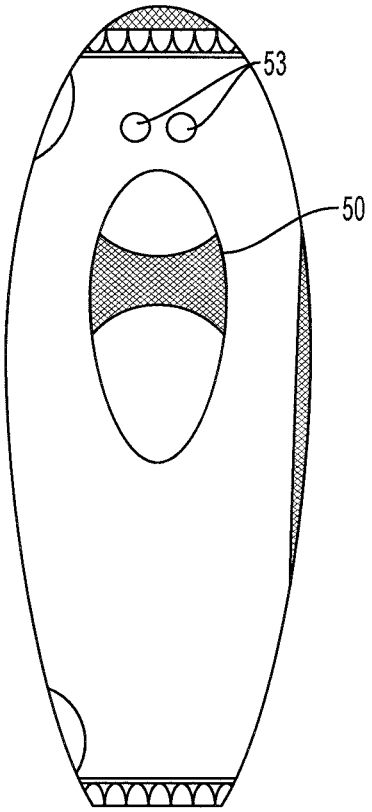
FIG. 11 is a view of the right side of the container of FIG. 1 showing a pushbutton and the self-retractable nozzles.
Figure 15D:
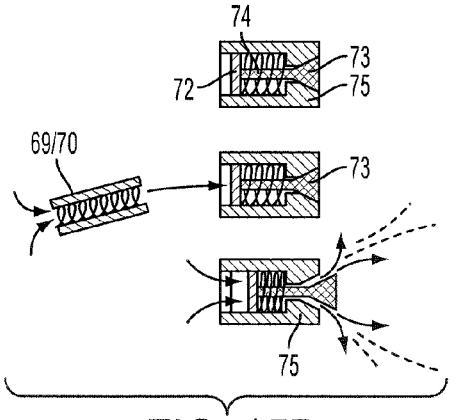
Figure 18:
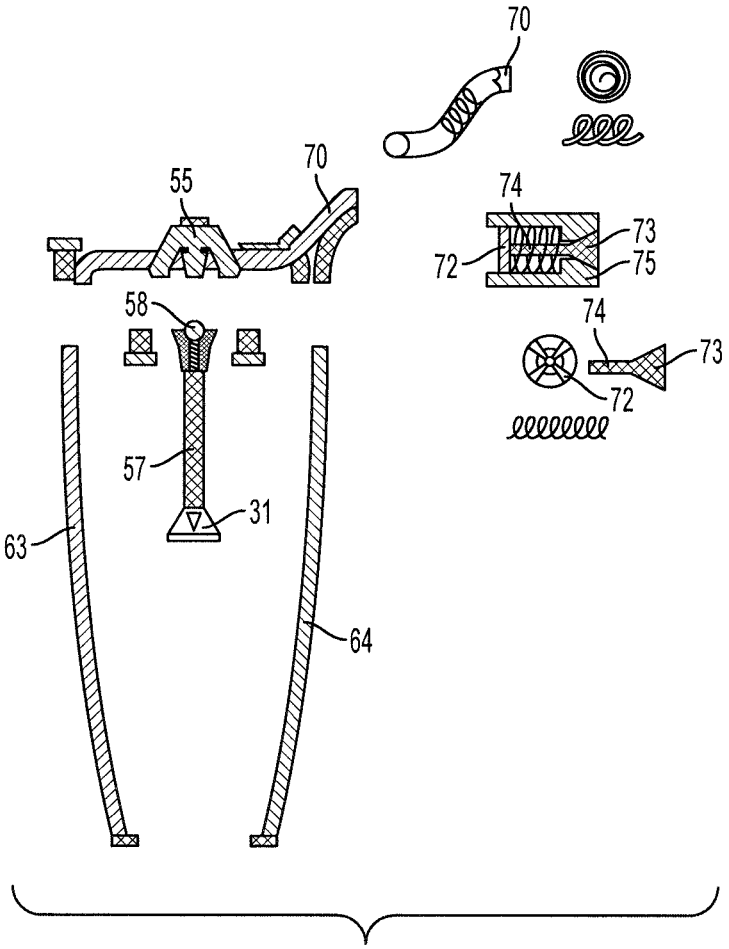

After the mixture of the two substances moves through the pipes 69 the mixture is ejected via one of two self-retracting pressure nozzles 53 (FIG. 11) located near the top of the container 19. As the mixture enters the dispensing area, it moves through a spring-loaded aperture-containing plate 72 (FIG. 15D, 18). The mixture causes pressure to build up on the inside of a cone 73, which is attached to the spring-loaded aperture containing plate 72 by shaft 74. This results in the cone 73 moving forward, allowing the pressurized mixture to be expelled, until the pressure is equalized. When there is no pressure on the spring-loaded aperture containing plate 72, the spring causes the cone 73 to go back to its initial position and the cone 73 seals off. A detailed view of the various valves and components of the self-retracting pressure nozzle 375 is shown in FIG. 18. Please note that there are seals located between all moving components and pressurized areas to prevent leakage.

Figure 17:
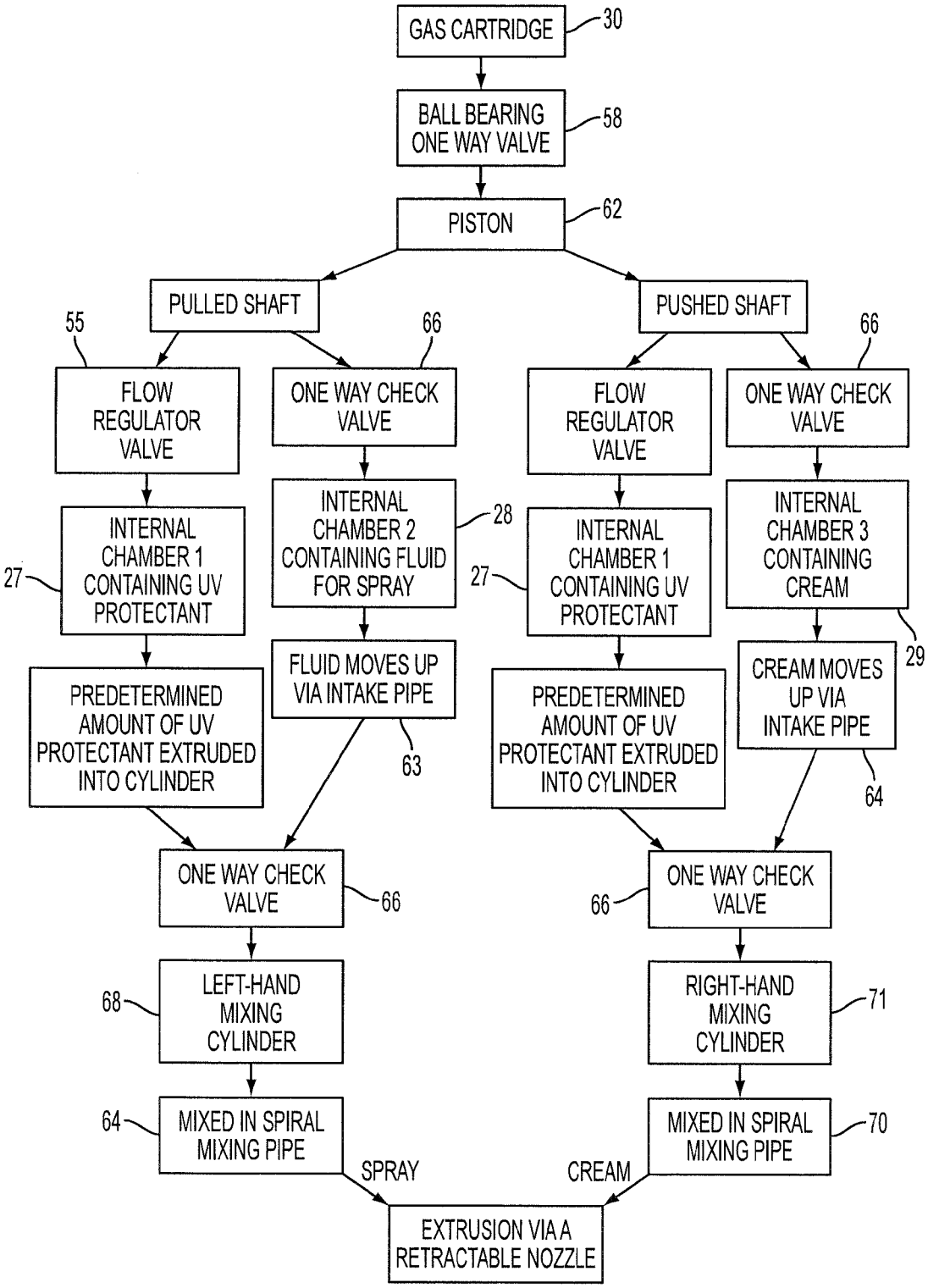
FIG. 17 is a block diagram representation of the propellant and substance flow through major components of the container based on the position of the pushbutton and FIG. 18 is an exploded view of the main internal components that channel pressurized propellant individual substances, and the resulting mixture throughout the containers until released.

FIG. 17 illustrates the various operations possible with the dispensing container of the present invention, as the result of the organization of the key components.

A pressure cartridge 30 dispenses propellant under control of a threaded conically-shaped flow regulating valve 55. A rubberized piston valve 59 controls the path of travel of the propellant throughout the device.

The rubberized piston 59 and rubber bearings 77 are controlled by moving the main shaft 62 left or right. Pushing the shaft 62 causes the pressurized propellant to flow through the threaded conically-shaped flow regulating valve 55 to internal compartment one 27 and through a one-way check valve 66 to internal compartment two 28. One way check valve 66 between compartment one 27 and compartment three 29 may contain a UV protectant. Internal compartment two 20 may contain a spray fluid for mixing with the UV protectant.

The UV protectant from internal compartment one 27 is moved out of compartment one 27 in a predetermined amount as determined by the user by adjusting the clicking adjustor wheel 20 on the container. The spray fluid from internal compartment 28 is moved out through a one way check valve 66 into a right hand grooved mixing compartment 77. The mixture moves out of the right hand formed mixing compartment 71 through the right hand mixing pipe where it is mixed to a self-retracting pressure nozzle 53 where it is flow regulated and expelled in a UV spray.

If the main shaft 62 of the rubberized piston 59 is pulled, the piston and rubber bearings move to the right. This causes pressurized propellant to flow through the threaded conically-shaped flow regulator valve 55 to internal compartment one 27 and through a one way check valve 66 to internal compartment three 29. The one way check valve 66 between internal compartment one 27 and internal compartment two 28 is blocked. Internal compartment one 27 contains the UV protectant. Internal compartment three may contain a cream based emollient for mixing with the UV protectant.

The UV protectant from internal compartment one 27 is moved out of the compartment in a predetermined amount, as determined by the user, by adjusting the clicking adjustor wheel 20. The cream based emollient from internal compartment three 29 is moved out of the compartment three, through a one-way check valve 66, into the left hand formed compartment 68. The mixture moves out of the left hand formed mixing compartment 68 through the left hand mixing pipe 70 where it is mixed and continues to a self-retracting pressure nozzle 53 where it is expelled as a UV cream.

The foregoing description of a preferred embodiment of the invention was presented for illustration and description. It was not intended to limit the invention to the precise form disclosed. Those skilled in the art will understand how to best utilize the invention in various embodiments and various modifications as are best suited to the use contemplated. The scope of the invention should not be limited by the specification, but defined by the following claims.

What is claimed is:

1. A handheld apparatus for holding substances in separate compartments, prior to mixing and dispensing a mixture, comprising:

a container sized to be held by a human hand;

a plurality of separate compartments for holding the substances located inside the container;

a mixing chamber in the container connected to the plurality of separate compartments;

an adjuster wheel having numbers thereon located on the container, and adapted for controlling the amount of substance moved into the mixing chamber;

a graded multilayered light sensitive strip on the outside of the container for detecting the level of UV light in the environment of the container, the multilayered strip containing a plurality of symbols, each symbol corresponding with a certain amount of UV light being detected; and a multilayer skin color matching sticker system on the outside of the container adjacent to the light sensitive strip, the skin color matching system having numbered skin color strips thereon that correlate with various darkness of human skin, allowing a user to select a skin color strip that matches the user's skin color associated with the amount of UV light being detected by the light sensitive strip, wherein the number on the selected skin color strip matches a number on the adjuster wheel.

2. The apparatus of claim 1, wherein the number on the adjuster wheel indicates dispensing of the correct substance for the selected skin color and the level of UV light being detected by the light sensitive strip.

* * * * *